US008181294B1

(12) United States Patent
Johnson

(10) Patent No.: US 8,181,294 B1
(45) Date of Patent: May 22, 2012

(54) CORNER MATTRESS SYSTEM

(76) Inventor: Subernia Y. Johnson, Lakeland, FL (US)

( * ) Notice: Subject to any disclaimer, the term of this patent is extended or adjusted under 35 U.S.C. 154(b) by 0 days.

(21) Appl. No.: 13/066,674

(22) Filed: Apr. 21, 2011

Related U.S. Application Data

(60) Provisional application No. 61/327,768, filed on Apr. 26, 2010.

(51) Int. Cl.
*A47C 31/00* (2006.01)

(52) U.S. Cl. ..... 5/692; 5/488; 5/723

(58) Field of Classification Search ..... 5/692, 691, 5/690, 488, 722, 723
See application file for complete search history.

(56) References Cited

U.S. PATENT DOCUMENTS 2,046,645 A * 7/1936 Mason ..... 5/695
3,056,146 A * 10/1962 Steckart ..... 5/692
5,953,779 A * 9/1999 Schwartz ..... 5/722

* cited by examiner

*Primary Examiner* — Robert G Santos

(57) ABSTRACT

A mattress has a central section. The central section has horizontal upper and lower surfaces. The central section has parallel first and second side faces. The central section has parallel first and second end faces. The side and end faces are vertically oriented. The side and end faces each have a rectangular configuration. The central section has four corner faces located between the end and side faces. The mattress has four similarly configured corner sections. Each corner section has a hypotenuse face positionable in facing contact with an associated corner face of the central section during use. Each corner section has two similarly configured leg faces positionable as planar extensions of contiguous side and end faces.

7 Claims, 3 Drawing Sheets

FIG. 1
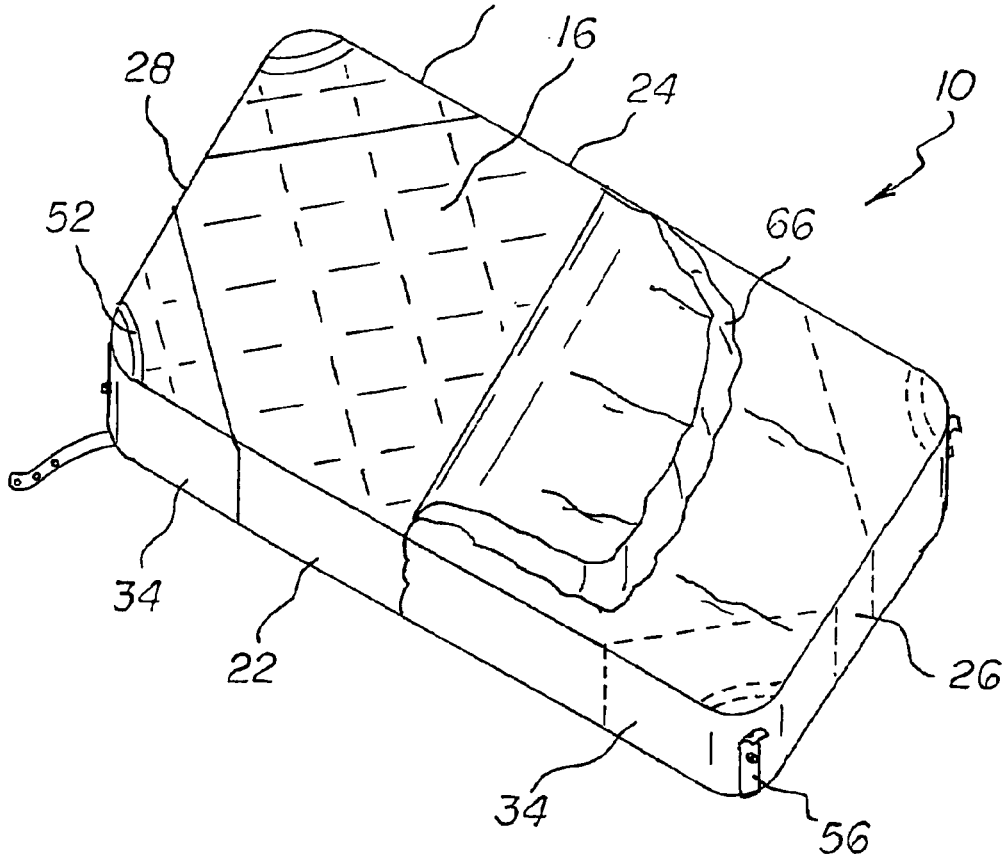
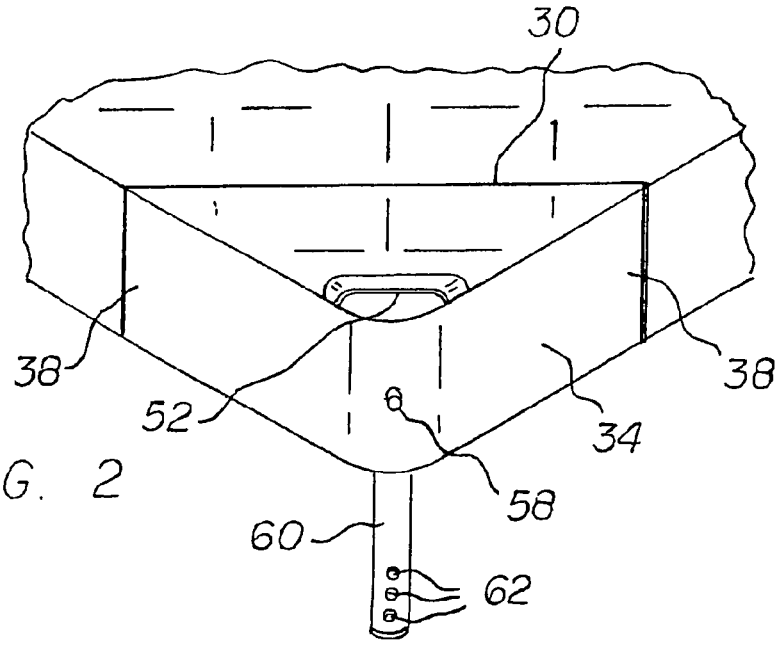
FIG. 2

FIG. 3
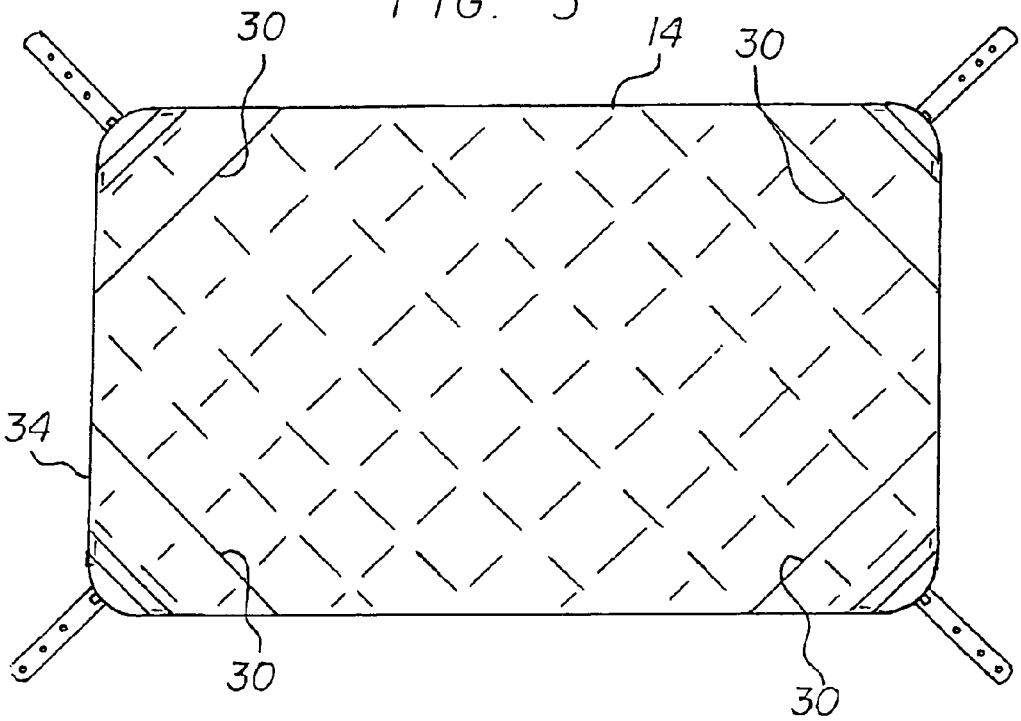
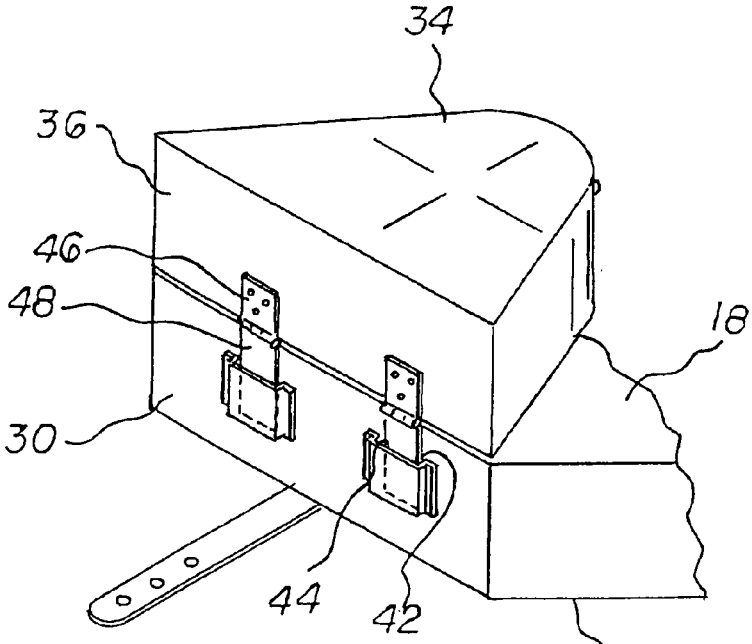
FIG. 4

FIG. 5
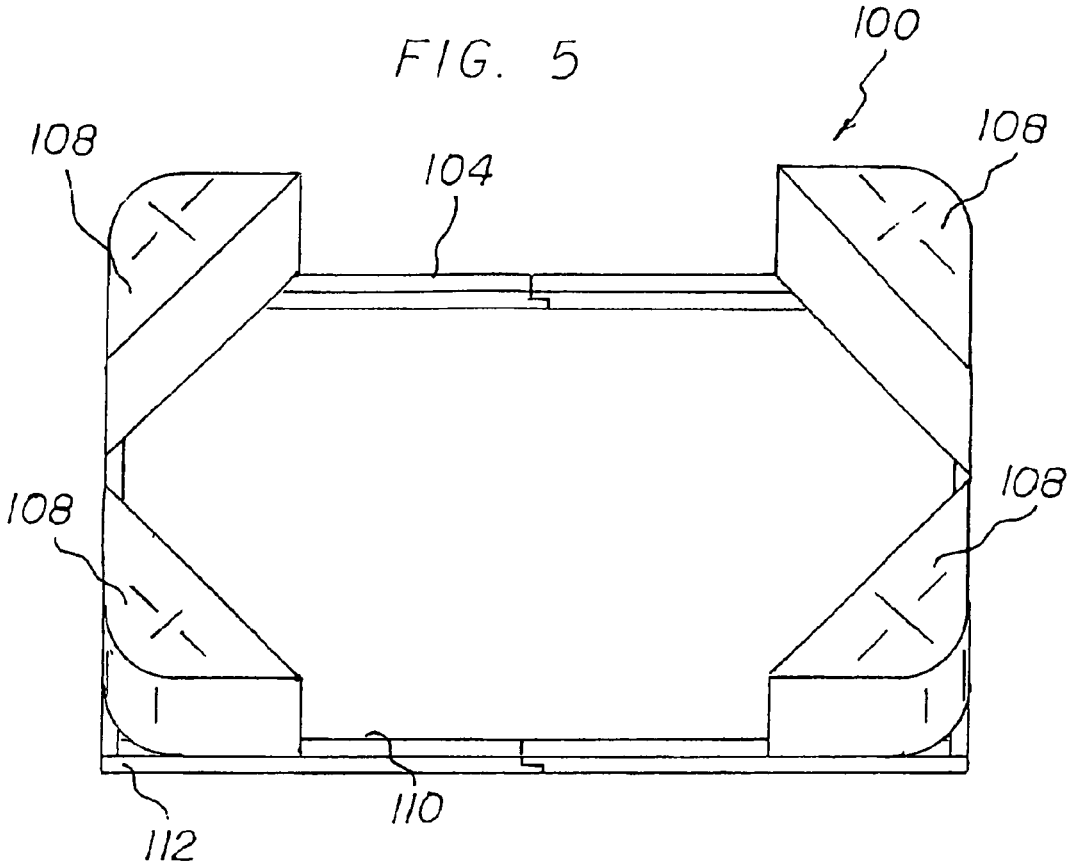
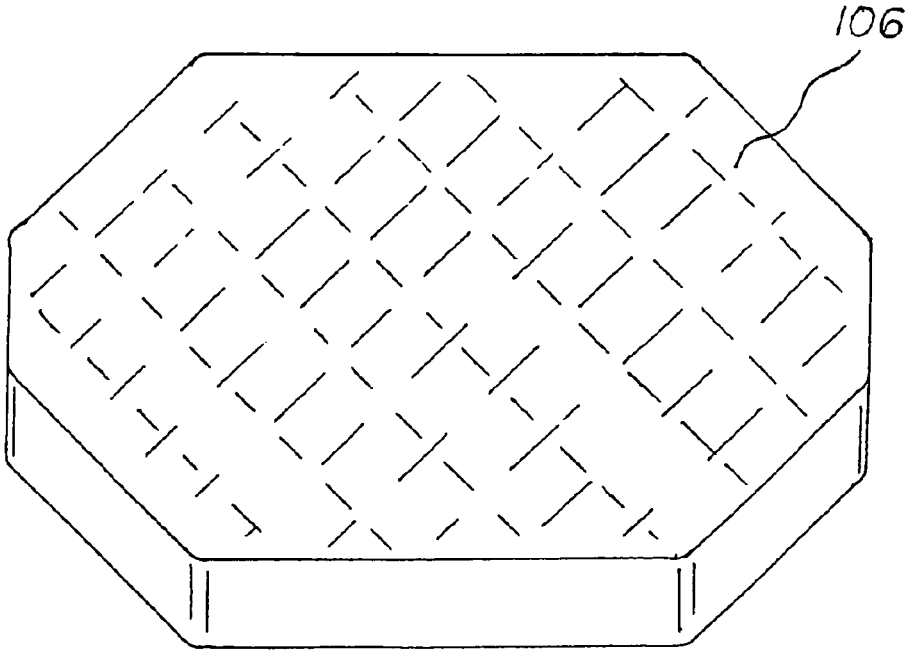
FIG. 6

CORNER MATTRESS SYSTEM

RELATED APPLICATION

The present application is based upon Provisional Patent Application 61/327,768 filed Apr. 26, 2010, the subject matter of which is incorporated herein by reference.

BACKGROUND OF THE INVENTION

Field of the Invention

The present invention relates to a corner mattress system and more particularly pertains to facilitating the positioning of a fitted sheet onto a mattress, and the retaining of the fitted sheet on a mattress, and the removal of the fitted sheet from the mattress, the positioning and retaining and the removal being done in a safe, rapid, convenient and economical manner.

SUMMARY OF THE INVENTION

In view of the disadvantages inherent in the known types of mattress systems of known designs and configurations now present in the prior art, the present invention provides an improved corner mattress system. As such, the general purpose of the present invention, which will be described subsequently in greater detail, is to provide a new and improved corner mattress system and method which has all the advantages of the prior art and none of the disadvantages.

To attain this, the present invention essentially comprises a corner mattress system. First provided is a mattress. The mattress has a central section. The central section has a horizontal upper surface. The central section has a parallel lower surface. The upper and lower surfaces are spaced by a thickness. The upper surface is pillowed. In this manner comfort is provided. The central section has parallel first and second side faces. The central section has parallel first and second end faces. The side and end faces are vertically oriented. The side and end faces each have a rectangular configuration. The central section has four corner faces. The corner faces are located between the end and side faces. The four corner faces are all vertically oriented. The four corner faces are all of the same size. The corner faces form an angle of 135 degrees with contiguous side and end faces.

The mattress has four similarly configured corner sections. Each corner section has a hypotenuse face. The hypotenuse face is positionable in facing contact with an associated corner face of the central section during use. Each corner section has two similarly configured leg faces. The leg faces are positionable as planar extensions of contiguous side and end faces. Each corner section constitutes an isosceles right triangle. Each corner has a thickness the same as the thickness of the central section. The central section and the corner sections form a rectangular mattress when positioned with the corner faces in facing contact with the hypotenuse faces. The corner sections each have an upper surface. The corner sections each have a lower surface. The upper and lower surfaces of the corner sections are provided in the planes of the upper and lower surfaces of the central section when in use.

Four similarly configured hinge assemblies are provided. Each hinge assembly has a hinge recess. The hinge recess is provided on a corner face. Each hinge assembly has a pivoting member. The pivoting member is provided on a hypotenuse face. Each pivoting member has a hinge leg. The hinge leg is removably received in an associated hinge recess. In this manner the corner sections are coupled to the central section.

Each pivoting member has an axis of rotation between the central and corner sections in the plane containing the upper surface of the central and corner sections.

Provided next is a handle. The handle is provided on the upper surface of each corner section. The handle spans the leg faces. The handle is adapted to facilitate handling of the mattress.

Further provided are four retainer assemblies. Each retainer assembly has an outwardly extending pin. The pin projects horizontally from the leg sections midway between the upper and lower surfaces. Each retainer assembly has an outwardly extending strap. The strap projects horizontally from between the leg sections in the plane of the lower surface of the corner sections. Each strap has a plurality of apertures. The apertures selectively receive an associated pin.

Provided last is a fitted sheet. The fitted sheet is adapted to be to be positioned onto the mattress. The fitted sheet is adapted to be removed from the mattress when the corner sections are pivoted upwardly. The fitted sheet is adapted to be retained on the mattress when the corner sections are pivoted downwardly. An aperture of each strap is adapted to receive an associated pin. A portion of the fitted sheet is provided there between. In this manner the fitted sheet is kept in place during use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved corner mattress system which has all of the advantages of the prior art mattress systems of known designs and configurations and none of the disadvantages.

It is another object of the present invention to provide a new and improved corner mattress system which may be easily and efficiently manufactured and marketed.

It is further object of the present invention to provide a new and improved corner mattress system which is of durable and reliable constructions.

An even further object of the present invention is to provide a new and improved corner mattress system which is susceptible of a low cost of manufacture with regard to both materials and labor, and which accordingly is then susceptible of low prices of sale to the consuming public, thereby making such corner mattress system economically available to the buying public.

Even still another object of the present invention is to provide a corner mattress system for facilitating the positioning of a fitted sheet onto a mattress, and the retaining of the fitted sheet on a mattress, and the removal of the fitted sheet from the mattress, the positioning and retaining and the removal being done in a safe, rapid, convenient and economical manner.

Lastly, it is an object of the present invention to provide a new and improved corner mattress system. A mattress has a central section. The central section has horizontal upper and lower surfaces. The central section has parallel first and second side faces. The central section has parallel first and second end faces. The side and end faces are vertically oriented. The side and end faces each have a rectangular configuration. The central section has four corner faces located between the end and side faces. The mattress has four similarly configured corner sections. Each corner section has a hypotenuse face positionable in facing contact with an associated corner face of the central section during use. Each corner section has two similarly configured leg faces positionable as planar extensions of contiguous side and end faces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a flip corner mattress system constructed in accordance with the principles of the present invention, a fitted sheet partly removed.

FIG. 2 is a perspective illustration of one corner of the system with the fitted sheet removed.

FIG. 3 is a plan view of the entire system with the fitted sheet removed.

FIG. 4 is a perspective illustration similar to FIG. 2 but with the corner section pivoted upwardly.

FIG. 5 is a perspective illustration of a frame and four corner sections constructed in accordance with an alternate embodiment of the invention.

FIG. 6 is a perspective illustration of a central section adapted to be positioned on a frame with four corner sections from the FIG. 5 embodiment.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved corner mattress system embodying the principles and concepts of the present invention and generally designated by the reference numeral 10 will be described.

The present invention, the corner mattress system 10 is comprised of a mattress configured and correlated so as to attain the desired objective.

First provided is a mattress 14. The mattress has a central section 16. The central section has a horizontal upper surface 18. The central section has a parallel lower surface 20. The upper and lower surfaces are spaced by a thickness. The upper surface is pillowed. In this manner comfort is provided. The central section has parallel first and second side faces 22, 24. The central section has parallel first and second end faces 26, 28. The side and end faces are vertically oriented. The side and end faces each have a rectangular configuration. The central section has four corner faces 30. The corner faces are located between the end and side faces. The four corner faces are all vertically oriented. The four corner faces are all of the same size. The corner faces form an angle of 135 degrees with contiguous side and end faces.

The mattress has four similarly configured corner sections 34. Each corner section has a hypotenuse face 36. The hypotenuse face is positionable in facing contact with an associated corner face of the central section during use. Each corner section has two similarly configured leg faces 38. The leg faces are positionable as planar extensions of contiguous side and end faces. Each corner section constitutes an isosceles right triangle. Each corner has a thickness the same as the thickness of the central section. The central section and the corner sections form a rectangular mattress when positioned with the corner faces in facing contact with the hypotenuse faces. The corner sections each have an upper surface. The corner sections each have a lower surface. The upper and lower surfaces of the corner sections are provided in the planes of the upper and lower surfaces of the central section when in use.

Four similarly configured hinge assemblies 42 are provided. Each hinge assembly has a hinge recess 44. The hinge recess is provided on a corner face. Each hinge assembly has a pivoting member 46. The pivoting member is provided on a hypotenuse face. Each pivoting member has a hinge leg 48. The hinge leg is removably received in an associated hinge recess. In this manner the corner sections are coupled to the central section. Each pivoting member has an axis of rotation between the central and corner sections in the plane containing the upper surface of the central and corner sections.

Provided next is a handle 52. The handle is provided on the upper surface of each corner section. The handle spans the leg faces. The handle is adapted to facilitate handling of the mattress.

Further provided are four retainer assemblies 56. Each retainer assembly has an outwardly extending pin 58. The pin projects horizontally from the leg faces midway between the upper and lower surfaces. Each retainer assembly has an outwardly extending strap 60. The strap projects horizontally from between the leg faces in the plane of the lower surface of the corner sections. Each strap has a plurality of apertures 62. The apertures selectively receive an associated pin.

Provided last is a fitted sheet 66. The fitted sheet is adapted to be to be positioned onto the mattress. The fitted sheet is adapted to be removed from the mattress when the corner sections are pivoted upwardly. The fitted sheet is adapted to be retained on the mattress when the corner sections are pivoted downwardly. An aperture of each strap is adapted to receive an associated pin. A portion of the fitted sheet is provided there between. In this manner the fitted sheet is kept in place during use.

Note is taken that the coupling between the central section and the corner sections is such that the central section may be inverted for use upside down or right side up. Similarly, the corner sections are adapted to be inverted for use upside down or right side up. This inverting relationship is true for both the hinge embodiment described above as well as for the frame embodiment described herein below.

An alternate embodiment 100 of the present invention is provided. A rectangular frame 104 is provided. A central section is provided. Corner sections 108 are also provided. The frame is adapted to receive the central section and the corner sections. The frame has a horizontal lower region 110. In this manner the central and corner sections are supported. The frame has a vertical upper region 112. In this manner the central and corner sections are retained in a rectangular orientation for use. The frame is constructed of a plurality of similarly configured snap-together parts, normally two or four parts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner mattress system comprising:

a mattress having a central section formed with horizontal upper and lower surfaces, the central section having parallel first and second side faces, the central section having parallel first and second end faces, the side and end faces being vertically oriented, the side and end faces each having a rectangular configuration, the central section having four corner faces located between the end and side faces; and the mattress having four similarly configured corner sections, each corner section having a hypotenuse face positionable in facing contact with an associated corner face of the central section during use, each corner section having two similarly configured leg faces positionable as planar extensions of contiguous side and end faces, each corner section having horizontal upper and lower surfaces positionable in planes coextensive with the upper and lower surfaces of the central section, each corner section having vertical linear edges extending between the upper and lower surfaces of the corner sections, the vertical linear edges positionable in contact with corresponding vertical linear edges between the side and end faces of the central section.

2. The system as set forth in claim 1 and further including:

four similarly configured hinge assemblies, each hinge assembly having a hinge recess on a corner face, each hinge assembly having a pivoting member on a hypotenuse face, each pivoting member having a hinge leg received in an associated hinge recess for coupling the corner sections to the central section.

3. The system as set forth in claim 1 and further including:

a handle on the upper surface of each corner section spanning the leg faces, the handle adapted to facilitate handling of the mattress.

4. The system as set forth in claim 1 and further including:

four retainer assemblies, each retainer assembly having an outwardly extending pin projecting horizontally from each leg face, each retainer assembly having an outwardly extending strap projecting horizontally from between the leg faces in the plane of the lower surface of the corner sections, each strap having a plurality of apertures selectively receiving an associated pin.

5. The system as set forth in claim 1 and further including:

a fitted sheet adapted to be positioned onto the mattress and removed there and adapted to be retained on the mattress during use.

6. The system (100) as set forth in claim 1 and further including:

a rectangular frame (104) adapted to receive the central section (106) and the corner sections (108), the frame having a horizontal lower region (110) for supporting the central and corner sections, the frame having a vertical upper region (112) for retaining the central and corner sections in a rectangular orientation for use, the frame being constructed of a plurality of similarly configured snap-together parts.

7. A flip corner mattress system (10) adapted to facilitate the positioning of a fitted sheet onto a mattress, and the retaining of the fitted sheet on a mattress, and the removal of the fitted sheet from the mattress, the positioning and retaining and the removal being done in a safe, rapid, convenient and economical manner, the system comprising, in combination:

a mattress (14) having a central section (16) formed with a horizontal upper surface (18) and a parallel lower surface (20), the upper and lower surfaces spaced by a thickness, the upper surface being pillowed for comfort, the central section having parallel first and second side faces (22), (24), the central section having parallel first and second end faces (26), (28), the side and end faces being vertically oriented, the side and end faces each having a rectangular configuration, the central section having four corner faces (30) located between the end and side faces, the four corner faces all being vertically oriented and of the same size, the corner faces forming an angle of 135 degrees with contiguous side and end faces;

the mattress having four similarly configured corner sections (34), each corner section having a hypotenuse face (36) positionable in facing contact with an associated corner face of the central section during use, each, corner section having two similarly configured leg faces (38) positionable as planar extensions of contiguous side and end faces, each corner section constituting an isosceles right triangle with a thickness the same as the thickness of the central section, the central section and the corner sections forming a rectangular mattress when positioned with the corner faces in facing contact with the hypotenuse faces, the corner sections each having an upper surface and a lower surface in the planes of the upper and lower surfaces of the central section when in use;

four similarly configured hinge assemblies (42), each hinge assembly having a hinge recess (44) on a corner face, each hinge assembly having a pivoting member (46) on a hypotenuse face, each pivoting member having a hinge leg (48) removably received in an associated hinge recess for coupling the corner sections to the central section, each pivoting member having an axis of rotation between the central and corner sections in the plane containing the upper surface of the central and corner sections;

a handle (52) on the upper surface of each corner section spanning the leg faces, the handle adapted to facilitate handling of the mattress;

four retainer assemblies (56), each retainer assembly having an outwardly extending pin (58) projecting horizontally from the leg faces midway between the upper and lower surfaces, each retainer assembly having an outwardly extending strap (60) projecting horizontally from between the leg faces in the plane of the lower surface of the corner sections, each strap having a plurality of apertures (62) selectively receiving an associated pin; and a fitted sheet (66) adapted to be positioned onto the mattress and removed there from when the corner sections are pivoted upwardly, the fitted sheet adapted to be retained on the mattress when the corner sections are pivoted downwardly, an aperture of each strap adapted to receive an associated pin with a portion of the fitted sheet there between for keeping the fitted sheet in place during use.

* * * * *